US012098846B2

(12) United States Patent
Laporte et al.

(10) Patent No.: US 12,098,846 B2
(45) Date of Patent: Sep. 24, 2024

(54) MONITORING AND/OR CONTROLLING SOLID FUEL BURNING DEVICES TO REDUCE EMISSIONS AND IMPROVE EFFICIENCY

(71) Applicant: MF Fire, Inc., Baltimore, MD (US)

(72) Inventors: Paul Laporte, Pikesville, MD (US); Ryan Fisher, New Market, MD (US); Taylor Myers, Hyattsville, MD (US)

(73) Assignee: MF FIRE, INC., Baltimore, MD (US)

( * ) Notice: Subject to any disclaimer, the term of this patent is extended or adjusted under 35 U.S.C. 154(b) by 958 days.

(21) Appl. No.: 17/019,654

(22) Filed: Sep. 14, 2020

(65) Prior Publication Data

US 2021/0080107 A1 Mar. 18, 2021

Related U.S. Application Data

(60) Provisional application No. 62/900,115, filed on Sep. 13, 2019.

(51) Int. Cl.
*F23N 5/02* (2006.01)
*F23N 5/26* (2006.01)

(52) U.S. Cl.
CPC ..... *F23N 5/022* (2013.01); *F23N 5/265* (2013.01); *F23N 2223/04* (2020.01); (Continued)

(58) Field of Classification Search
CPC ..... F23N 5/022; F23N 5/265; F23N 5/003; F23N 5/006; F23N 5/02; F23N 5/242; F23N 2223/04; F23N 2223/06; F23N 2225/08; F23N 2225/04; F23N 2231/20; F23N 2239/02; F24B 1/006; F24B 1/028
See application file for complete search history.

(56) References Cited

U.S. PATENT DOCUMENTS 5,355,474 A * 10/1994 Thuraisngham .... G06F 21/6218 707/999.009
10,041,682 B1 * 8/2018 Myers ..... F23L 9/02
(Continued)

FOREIGN PATENT DOCUMENTS

DE 4430447 A1 * 2/1996 ..... B60W 10/06
WO 2021051038 A1 3/2021

OTHER PUBLICATIONS

May 5, 2023 1st Office Action PT215968CA.

*Primary Examiner* — Douglas Kay
(74) *Attorney, Agent, or Firm* — Tarolli, Sundheim, Covell & Tummino LLP

(57) ABSTRACT

The efficiency of a solid fuel burning device can be increased and the emissions can be reduced with proper monitoring and guidance. At least one memory and processor can receive information related to operating conditions of a solid fuel burning device from at least one sensor and filter that information and determine a property related to usage of the solid fuel burning device based on fitting the filtered information to a set of reference conditions. The property can be compared to a lookup table comprising triggering events and when the property satisfies one of the triggering events appropriate guidance for operation of the solid fuel burning device can be retrieved and outputted so that alterations can be made to the operating conditions of the solid fuel burning device.

18 Claims, 10 Drawing Sheets

(52) U.S. Cl.
CPC ..... *F23N 2223/06* (2020.01); *F23N 2225/08* (2020.01); *F23N 2231/20* (2020.01); *F23N 2239/02* (2020.01)

(56) References Cited

U.S. PATENT DOCUMENTS

| | | | | |
|---|---|---|---|---|
| 2006/0042261 | A1* | 3/2006 | Taware | F23N 5/003 60/773 |
| 2007/0062196 | A1* | 3/2007 | Gleeson | F23N 5/242 60/722 |
| 2007/0292810 | A1* | 12/2007 | Maiello | F24C 3/006 431/59 |
| 2012/0116589 | A1* | 5/2012 | Schneider | G05B 15/00 700/274 |
| 2015/0051847 | A1* | 2/2015 | Angello | F23N 5/242 702/35 |
| 2015/0081086 | A1* | 3/2015 | Hallowell | F23N 5/003 700/209 |
| 2017/0184315 | A1* | 6/2017 | Nolan | F24B 13/04 |
| 2018/0142627 | A1* | 5/2018 | Harper | F02C 9/26 |
| 2020/0182463 | A1* | 6/2020 | Obrecht | F23N 5/123 |

* cited by examiner

MONITORING AND/OR CONTROLLING SOLID FUEL BURNING DEVICES TO REDUCE EMISSIONS AND IMPROVE EFFICIENCY

RELATED APPLICATIONS

This application claims the benefit of U.S. Provisional Application No. 62/900,115, entitled "APPARATUS AND METHOD FOR MONITORING A SOLID FUEL BURNING DEVICE," filed Sep. 13, 2019. The entirety of this application is hereby incorporated by reference for all purposes.

TECHNICAL FIELD

The present disclosure relates generally to reducing emissions and improving the efficiency of solid fuel burning devices, more specifically, to systems and methods for monitoring and/or controlling operating conditions to reduce emissions and/or improve efficiency of solid fuel burning devices.

BACKGROUND

Solid fuel burning devices, such as wood or coal burning stoves, constitute an inexpensive source of heat and have been used for centuries to heat homes and other buildings. All around the world, solid fuel burning devices are still relied on as a heat source (with approximately 12 million wood stoves in the United States alone). However, conventional solid fuel burning devices suffer from a number of inadequacies that limit their performance and cause unexpected and excessive emissions with each use, such as the lack of readily acquirable information related to operating conditions and insufficient knowledge of how best to respond to operating conditions. Excessive emissions from solid fuel burning devices are a contributor to global air pollution levels, which can cause or exacerbate cardiorespiratory illnesses, as well as contribute to global warming.

In real-world use, most solid fuel burning devices are significantly more polluting than test lab data suggests. User-specific contribution to wood stove emission alone has been reported as high as 600% over certified stove baseline emissions. This increase can be based on contributing factors including load size, log size, reload timing, premature or late catalyst engagement, fuel type, and air settings. A vast majority of excess emissions are preventable with user knowledge and training.

SUMMARY

Provided herein are systems and methods for monitoring and/or controlling operating conditions to reduce emissions from and/or improve the efficiency of solid fuel burning devices. In addition, the systems and methods can teach users how to properly operate their solid fuel burning devices in response to the monitored operating conditions in order to prevent excess emissions caused by user error.

In one aspect, a system for monitoring environmental conditions of a solid fuel burning device and alerting a user to improper usage of the solid fuel burning device is described. The system includes at least one memory storing instructions and at least one processor configured to access instructions. Upon execution of the instructions, the system can sample at least one sensor at a frequency to receive information related to at least one operating condition of a solid fuel burning device; filter the information based on a property associated with the solid fuel burning device and specified by a user; determine a property related to usage of the solid fuel burning device based on fitting the filtered information to a set of reference conditions; compare the property related to the usage of the solid fuel burning device to a lookup table that includes a plurality of triggering events, and retrieve guidance for operation of the solid fuel burning device based on the property satisfying one of the plurality of triggering events; and output the guidance.

In another aspect, a method for monitoring environmental conditions of a solid fuel burning device and alerting a user to improper usage of the solid fuel burning device is described. Steps of the method are executed by a system that includes at least one processor. The steps of the method include at least: sampling at least one sensor at a frequency to receive information related to at least one operating condition of a solid fuel burning device; filtering the information based on a property associated with the solid fuel burning device and specified by a user; determining a property related to usage of the solid fuel burning device by fitting the filtered information to a set of reference conditions; comparing the property related to the usage of the solid fuel burning device to a lookup table that includes a plurality of triggering events, and retrieving guidance for operation of the solid fuel burning device based on the property satisfying one of the plurality of triggering events; and outputting the guidance to the user.

BRIEF DESCRIPTION OF THE DRAWINGS

The foregoing and other features of the present disclosure will become apparent to those skilled in the art to which the present disclosure relates upon reading the following description with reference to the accompanying drawings, in which.

DETAILED DESCRIPTION

I. Definitions

Figure 1:
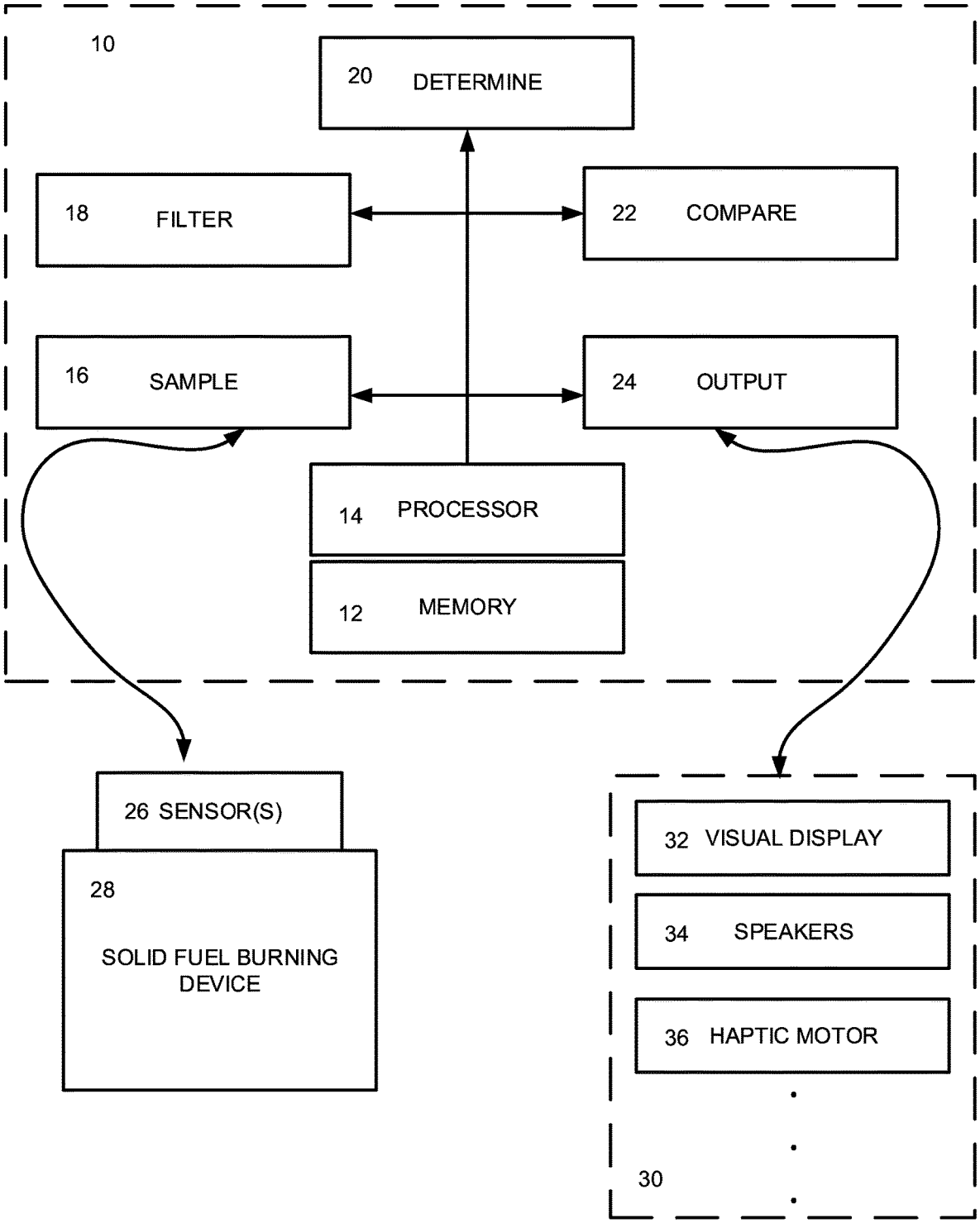
FIG. 1 is a schematic diagram showing a system for improving the efficiency and/or reducing emissions from a solid fuel burning device.

Unless otherwise defined, all technical terms used herein have the same meaning as commonly understood by one of ordinary skill in the art to which the present disclosure pertains.

As used herein, the singular forms "a," "an" and "the" can also include the plural forms, unless the context clearly indicates otherwise.

As used herein, the terms "comprises" and/or "comprising," can specify the presence of stated features, steps, operations, elements, and/or components, but do not preclude the presence or addition of one or more other features, steps, operations, elements, components, and/or groups.

As used herein, the term "and/or" can include any and all combinations of one or more of the associated listed items.

As used herein, the terms "first," "second," etc. should not limit the elements being described by these terms. These terms are only used to distinguish one element from another. Thus, a "first" element discussed below could also be termed a "second" element without departing from the teachings of the present disclosure. The sequence of operations (or acts/steps) is not limited to the order presented in the claims or figures unless specifically indicated otherwise.

As used herein, the terms "user" or "operator" can be used interchangeably to refer to an individual who prepares for, assists, and/or operates an application, a controller, and/or mobile device associated with a solid fuel burning device. In some instances, the user can prepare, assist, and/or operate the solid fuel burning device. In other instances, the user can access a database associated with the solid fuel burning device.

As used herein, the term "solid fuel burning device" can include any device that combusts solid fuel (e.g., wood, charcoal, peat, coal, hexamine fuel tablets, wood pellets, grains, etc.). Solid fuel burning devices can include, but are not limited to, wood stoves, other solid fuel burning stoves, fireplaces, fireplaces inserts, combination fuel furnaces or boilers used for space heating which can burn solid fuel, or solid fuel burning cooking stoves.

As used herein, the term "PM2.5" refers to fine inhalable particles, solid or liquid, having diameters that are generally 2.5 micrometers and smaller. PM2.5 particles are considered dangerous because their small size allows particles to travel deep into the respiratory tract and into the lungs. Long term or acute exposure to PM2.5 particles can cause lung and heart problems.

As used herein, the term "operating conditions" refers to one or more properties associated with the running of a solid fuel burning device. Each of the one or more properties can be monitored by one or more sensors. Operating conditions can vary depending on the type of solid fuel burning device and intended use of solid fuel burning device.

As used herein, the term "sensor" refers to a device that detects or measures a physical property as data and sends the data to a device containing a processor. A sensor can be, for example, a temperature sensor, such as a thermocouple, a mechanical sensor, such as a pressure sensor or proximity sensor, or any other type of sensor. A sensor can detect, for example, temperature, pressure, proximity to two components, chemical compounds or particulates such as oxygen, carbon monoxide, carbon dioxide, and PM2.5 particles, or the like. Sensors can be placed inside a solid fuel burning device (e.g., in the primary fire box, on the catalyst, inside the chimney/exhaust pipe, on the inside of the door, etc.), on the outside of a solid fuel burning device (e.g., on the outside of the door, on the outside of the firebox, on the outside of the chimney/exhaust pipe, etc.), and/or generally in the room surrounding the solid fuel burning device (e.g., by a thermostat, built into a controller, etc.).

As used herein, the phrase "inside of the solid fuel burning device," and variations thereof, refers to locations on the inner side or surface of the solid fuel burning device, such as the interior of the firebox or the chimney, and locations in the interior space bounded by the outer shell of the solid fuel burning device, including locations on or in components that make up the solid fuel burning device (e.g., the catalyst, the door, the baffle, etc.).

As used herein, the phrase "outside of the solid fuel burning device," and variations thereof, refers to locations on the exterior surface of a solid fuel burning device (e.g., the external side of the door, the external side of the firebox, the external side of the chimney, etc.) or locations beyond the exterior portions of the solid fuel burning device (e.g., locations in the room or building containing the solid fuel burning device).

As used herein, the term "reference condition" refers to specific, predetermined values or ranges for operating conditions that lead to optimal efficiency and emissions output of a solid fuel burning device. Reference conditions are determined for a solid fuel burning device based on one or more of: manufacturer specifications, laboratory test results, and information relating to environmental factors and burn intentions. The reference conditions can be, for example, retrieved from a remote directory, input by a user, or the like.

An example of a reference condition is an ideal fire usage curve, as used herein, the term "fire usage curve" refers to a graphical representation of one or more conditions from a set of reference conditions. An ideal fire usage curve can be based on information input by the user and on reference conditions for a solid fuel burning device that may be based on laboratory testing and/or manufacturer specifications. A real-time fire usage curve can be based on the samples of information relating to operating conditions taken by the at least one sensor.

II. Overview

Solid fuel burning devices, such as wood or coal burning stoves, provide an inexpensive source of heat and are still relied on as primary or secondary heat sources all around the world. While solid fuel burning devices are widely used, the devices suffer from certain deficiencies that can limit their performance. These deficiencies include the lack of readily acquirable information related to operating conditions of the solid fuel burning devices and insufficient knowledge of how best to respond to operating conditions. These inadequacies result in inefficient and improper use of solid fuel burning devices and cause unexpected and excessive emissions.

In real-world use, most solid fuel burning devices are significantly more polluting than test lab data suggests. User-specific contribution to wood stove emission alone has been reported as high as 600% over certified stove baseline emissions. This increase can be based on contributing factors such as load size, log size, reload timing, premature or late catalyst engagement, fuel type, and air settings. A vast majority of excess emissions are preventable with user knowledge and training. The reduction of polluting emissions is an ongoing challenge for individuals, companies, and governments in the fight against global warming. Large-scale reduction in solid fuel burning device emissions, as much as 80% reduction, is possible with proper monitoring of solid fuel burning devices and proper user training. Proper monitoring and user training lead to better burn practices, such as, but not limited to, not burning wet wood, not overloading the fuel in the solid fuel burning device, not opening the door of the solid fuel burning device too soon, not keeping the door of the solid fuel burning device open too long, and not letting the fire in the solid fuel burning device get too low. Better burn practices reduce the emissions and the amount of solid fuel needed to create the same quantity of heat. Additionally, significant increases in real world monitoring of solid fuel burning devices and collection of the monitored information in a central database would provide unparalleled access to real world burn data for scientific research, policy setting, and program funding justifications.

III. System

One aspect of the present disclosure can include a system 10 (shown in FIG. 1) for reducing emissions from a solid fuel burning device and/or improving the efficiency of a solid fuel burning device. The system 10 can provide real world monitoring and collection of information related to the solid fuel burning device. The system 10 can receive information related to operating conditions of the solid fuel burning device from at least one sensor, filter that information, and determine a property related to usage of the solid fuel burning device based on fitting the filtered information to a set of reference conditions. The property can be compared to a lookup table comprising triggering events and when the property satisfies one of the triggering events appropriate guidance for operation of the solid fuel burning device can be retrieved and output so that alterations can be made to the operating conditions of the solid fuel burning device.

As shown in FIG. 1, the system 10 includes at least one non-transitory memory 12 storing instructions, and at least one hardware processor 14 configured to access the at least one non-transitory memory 12 and execute the instructions. The instructions can include sampling 16 at least one sensor 26 at a frequency to receive information related to at least one operating condition of the solid fuel burning device 28, filter 18 the information based on a property associated with the solid fuel burning device 28 and specified by a user, determine 20 a property related to usage of the solid fuel burning device based on fitting the filtered information to a set of reference conditions, compare 22 the property related to the usage of the solid fuel burning device to a lookup table, (that can include a plurality of triggering events), and retrieve guidance for operation of the solid fuel burning device when the property satisfies a predetermined number (e.g., at least one) of the plurality of triggering events; and output 24 the guidance via at least one display 30. The at least one display 30 can include at least one of: a visual display 32, a speaker 34, a haptic motor 36, or the like.

The at least one non-transitory memory 12 of system 10 can store the machine-executable instruction and electronic data. Examples of the at least one non-transitory memory 12 can include volatile memory (e.g., RAM), nonvolatile memory (e.g., a hard disk, a flash memory, a solid state drive, or the like), or a combination of both. The at least one processor 14 can include one or more processing cores, for example, which can access the non-transitory memory 21 and can optionally implement functionality of a cloud-based system (not shown). The system 10 can also include a wireless transmitter (not shown), which can allow communication between at least two of: the at least one non-transitory memory 12, the at least one processor 14, the at least one sensor 26, and the at least one display 30. The wireless transmitter can communicate according to one or more protocols, including Bluetooth, cellular, WiFi, or the like. In some instances, the system 10 can also include a wired connection.

The at least one sensor 26 associated with the solid fuel burning device 28 can be located outside of the solid fuel burning device 28 or inside of the solid fuel burning device 28. When the at least one sensor 26 includes more than one sensor, the sensors can be located entirely outside of the solid fuel burning device 28, entirely inside of the solid fuel burning device 28, or some sensors inside and some sensors outside of the solid fuel burning device 28. The at least one sensor 26 can preferably include a temperature sensor or a mechanical sensor. The temperature sensor can be, for example, a thermocouple. The mechanical sensor can be, for example, a proximity sensor, a pressure sensor, a gyroscope, or an accelerometer. Other types of sensors, such as chemical sensors for determining gas and smoke compositions (e.g., PM2.5, PM10, Carbon monoxide, Carbon dioxide, etc.) for example, can also be used inside of or outside of the solid fuel burning device 28.

The at least one display 30, can be housed separately from the at least one non-transitory memory 12 and the at least one processor 14 or the at least one display 30 can be fully integrated in the same housing as one or both of the at least one non-transitory memory 12 and the at least one processor 14. The at least one display 30 can further include one or more of: a visual display 32, one or more speakers 34, and a haptic motor 36. When the system 10 outputs the guidance, the guidance can be output with an alert to the user, wherein the alert is a visual alert, a tactile alert, and/or an auditory alert. The display 30 can indicate the alert by the visual display 32 showing the visual alert, the haptic motor 36 generating the tactile alert, and the one or more speakers sounding an auditory alert. Additionally, the display 30 can output the guidance as auditory and/or visual instructions by using the visual display to show the instructions in words, pictures, or animation and/or by using the one or more speakers to verbalize the instructions.

Figure 2:
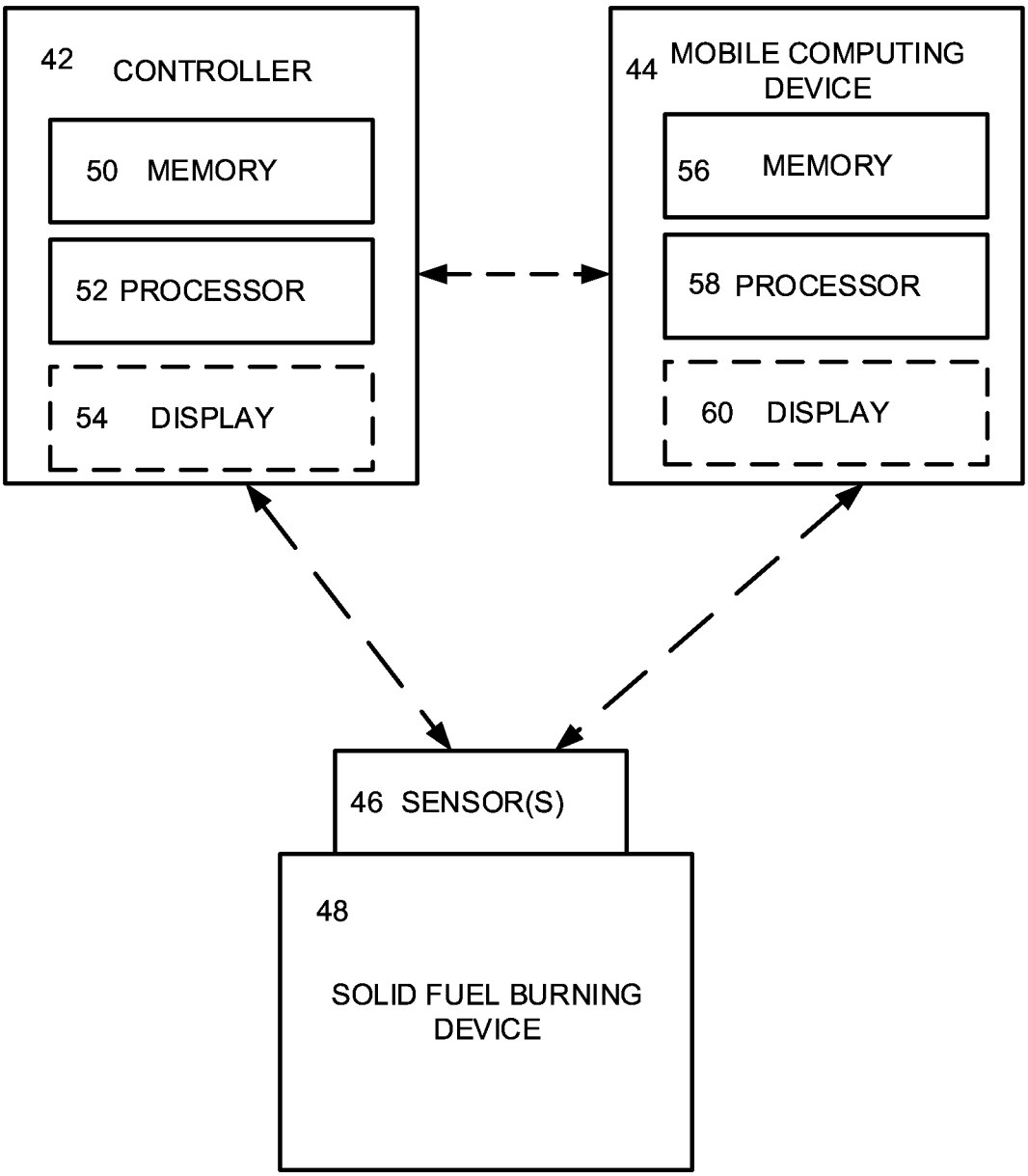
FIG. 2 is a schematic diagram showing an example implementation of the system of FIG. 1 on a controller and/or a mobile computing device.

As shown in further detail in FIG. 2, the system 10 can be embodied, at least in part, on a controller 42 associated with the solid fuel burning device 48 and/or a mobile computing device 44 associated with the user. The controller 42 can include at least one non-transitory memory 50 and at least one processor 52 and can optionally include a display 54. Similarly, the mobile computing device 40 can include at least another non-transitory memory 56 and at least another processor 58 and can optionally include a display 60. It should be noted that any, or all, of the components of the system 10 of FIG. 1 can be executed by either (or both) of the controller 42 or the mobile computing device 44.

Figure 3:
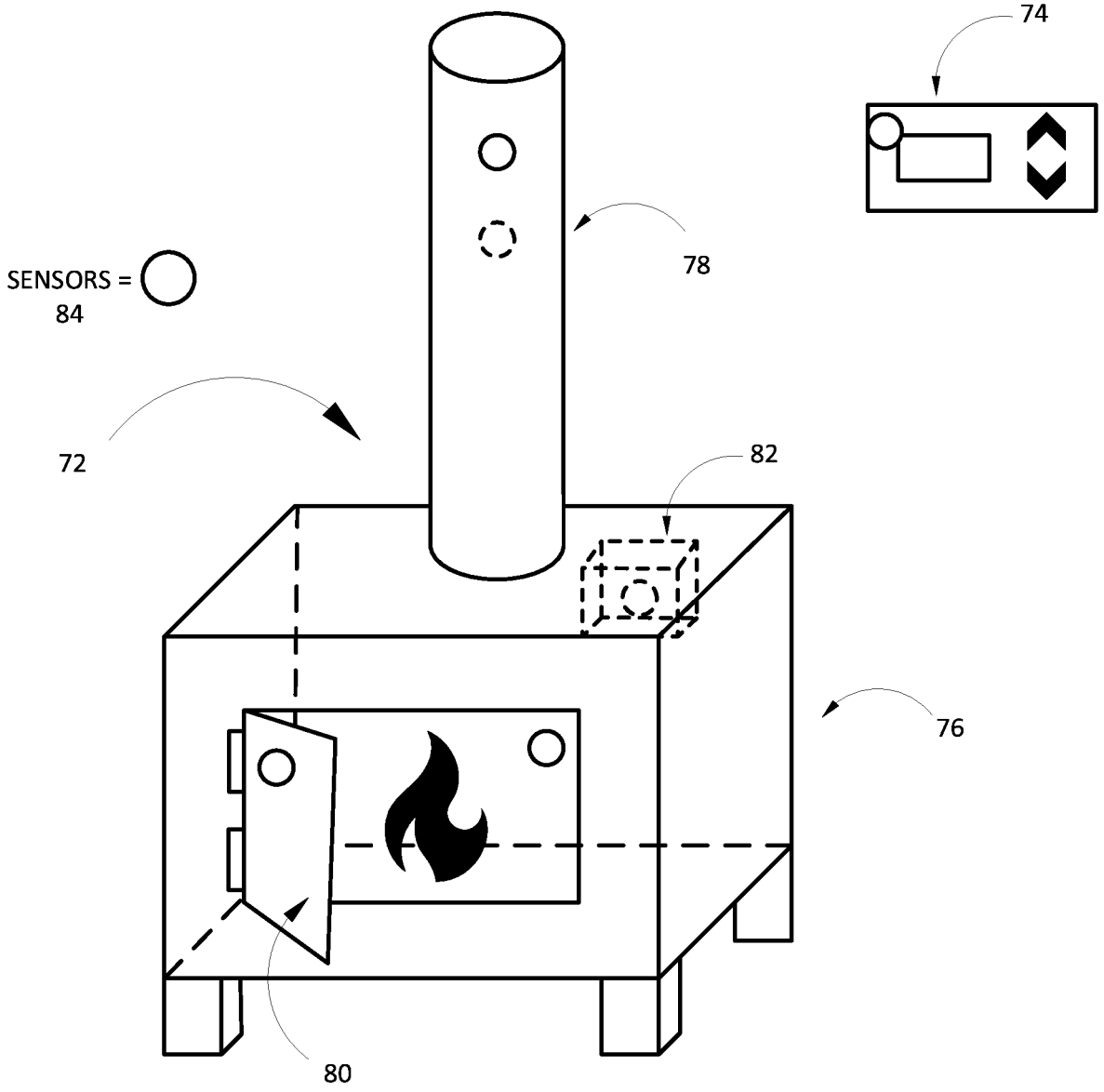
FIG. 3 is an example of example sensor placements in or on a solid fuel burning device and its environment.

FIG. 3 shows an example of a solid fuel burning device 72 in proximity to a thermostat 74 (e.g., a living room containing a wood burning stove and a thermostat). The solid fuel burning device 72 includes at least a firebox 76 and an exhaust pipe 78. The firebox 76 is the chamber where the fuel is burned in the solid fuel burning device 72 (e.g., where wood is placed and burned in a wood burning stove). The solid fuel burning device 72 may have one firebox 76 or more than one firebox 76 (e.g., a primary firebox, a secondary firebox, etc.). The firebox 76 can further include at least one door 80, a vent (not shown), and at least one opening into the exhaust pipe 78. Solid fuel is added to the firebox 76 at the beginning or end of a firing cycle (e.g., the time between the ignition of the solid fuel and its consumption to a coal bed) by opening the door 80, placing the fuel inside the firebox 76, and then closing the door 80. Preferably each firing cycle should provide between 4 and 8 hours of heat if the solid fuel burning device 72 is a wood stove, and the door 80 should not need to be opened more than that.

The door 80 can also include a locking mechanism (not shown) to prevent the door 80 from swinging open and letting air drafts into the firebox 76. The vent (not shown) can be in the firebox 76 itself or in the door 80. The vent can be opened or closed to varying degrees, depending on the amount of air needed to feed the combustion of the solid fuel. The exhaust pipe 78 (also known as a chimney, stack, smokestack, flue, etc.) is a pipe or channel, usually vertical, that conducts smoke and combustion gases away from the firebox 76 of the solid fuel burning device 72 and out of a building to be released into the atmosphere.

Optionally, the solid fuel burning device 72 can also include a catalyst 82 (also known as a catalytic combustor). A catalyst 82 has a ceramic honeycomb design that can be wheel, oval, or rectangular in shape and is often coated with palladium or another noble metal to withstand the harsh environments of heating applications. When solid fuels are burned, the solid fuels give off combustion gases that often escape the solid fuel burning device 72 through the exhaust pipe 78. Generally, in order for at least some of the combustion gases to burn off before escaping the solid fuel burning device 72, the heat generated by the combustion of the solid fuel must be approximately 1000° F. However, when a solid fuel burning device 72 has a catalyst 82, the gases that are not burned pass through the catalyst and interact with the palladium or other noble metal coating on the honeycomb causing the gases to burn at much lower temperatures, around 500° F. The catalyst 82 burning the gases in the smoke as fuel reduces emissions and the amount of fuel needed to generate the same amount of heat.

The solid fuel burning device 72 can also include a plurality of other components not shown in FIG. 3, such as a bypass or a baffle, to assist with the burning of solid fuel. A bypass (also referred to as a bypass damper or a damper) is a moveable plate that regulates the flow of gases through a solid fuel burning device. Older stoves sometimes incorporated a pipe damper, a round valve in the exhaust pipe, that the user closed or opened to reduce or increase the flow of gasses through the stove. New, catalytic stoves can have a bypass damper in the stove itself. This is a metal plate in the stove, which, when open, allows smoke and gasses to bypass, that is, move around, the catalyst. When the stove is heated to the correct temperature for the catalyst to operate, the user closes the bypass damper, forcing the smoke through the catalyst. A baffle is a barrier that slows and/or changes the direction of the gasses in a solid fuel burning device so that the amount of time the gasses remain in the firebox before entering the chimney increases, allowing time for more complete combustion and greater heat generation. FIG. 3 is not drawn to scale and components of the solid fuel burning device 72, both shown and not shown, can be located in any number of configurations.

FIG. 3 also shows possible locations for the at least one sensor 26 of system 10 of FIG. 1. The sensors 84 can be located in or on the solid fuel burning device 72, on or integrated with the thermostat 74, or at other locations (not shown) outside of the solid fuel burning device 72. In one aspect, the at least one sensor 84 is located outside of the solid fuel burning device 72 (e.g., on any outside surface of the solid fuel burning device 72 or at a location not in contact with the solid fuel burning device 72). When the at least one sensor 84 is located outside of the solid fuel burning device 72 the at least one sensor 84 can be located, for example, on at least one of: on top of the solid fuel burning device 72 (e.g., on top of the firebox 76), on an exhaust pipe 78 of the solid fuel burning device 72, on a thermostat 74 located in a building housing the solid fuel burning device 72, and on a door 80 of the solid fuel burning device 72. In another aspect, the at least one sensor 84 can include at least another sensor 84 located inside the solid fuel burning device 72 in at least one of: a primary firebox (e.g., firebox 76), a secondary combustion area, a catalytic combustor (e.g., catalyst 82), and an exhaust pipe (e.g., exhaust pipe 78). Any number of sensors 84 can be located inside or outside of the solid fuel burning device 72 as long as one sensor 84 is located at least inside or outside of the solid fuel burning device 72.

The sensors 84, depending on their placement, can detect different types of information. For example, temperature sensors inside or outside of the solid fuel burning device determine internal, external, or ambient temperatures, a pressure sensor in the exhaust pipe can sense the pressure of smoke/gases passing into the atmosphere, a pressure sensor or proximity sensor on the door can determine if the door is open or shut, or somewhere in between. If the sensor is a chemical sensor located in the firebox or exhaust pipe or near the exit of the exhaust pipe it can sense the amount of oxygen, carbon monoxide, carbon dioxide, other gases, and particulates (such as PM2.5 particles) inside and exiting the solid fuel burning device.

Referring again to FIG. 1, the at least one processor 14 samples the at least one sensor 26 at a frequency to receive information related to at least one operating condition of a solid fuel burning device 28. The frequency of sampling can be continuous or periodic (e.g., every minute, 5 minutes, 10 minutes, etc.). The frequency can be predetermined, or it can be chosen by a user of the system 10. The information related to operating conditions of the solid fuel burning device 28 depends on where the at least one sensor(s) 26 is located and what type of sensor(s) the at least one sensor 26 is. Operating conditions can include, but are not limited to, internal and external temperatures, the rate the temperatures change, if the door of the solid fuel device 28 is open, the smoke and combustion levels generated by burning the solid fuel, etc. Optionally, information related to operating conditions can be stored in the at least one non-transitory memory 12.

Once the information related to the at least one operating condition of the solid fuel device is received by the at least one processor 14, the information is filtered based on a property associated with a user. The property associated with the solid fuel burning device 28 and specified by the user can include, but is not limited to, at least one of: the type of solid fuel burning device 28 the system is being used with, the specifications of the solid fuel burning device 28, the location of the at least one sensor 26, the user's desired type of burn (e.g., long/slow burn, quick burn, primary heating, secondary heating, etc.), or the user's goal emissions level. The user can enter the property associated with the solid fuel burning device 28 and specified by the user into the system or the user can enter other information (e.g., if prompted by the system) that the system 10 can use to formulate the property associated with the solid fuel burning device and specified by the user. The information related to the at least one operating condition is filtered because not all received information may be needed to properly operate the solid fuel burning device 28.

A property related to usage of the solid fuel burning device is determined based on fitting the filtered information to a set of reference conditions. The set of reference conditions can be based at least partially on at least one property associated with the solid fuel burning device 28 and specified by the user, such as the specifications for the solid fuel burning device. The reference conditions can include, but are not limited to, the ideal internal/external temperatures for the solid fuel burning device 28, ideal air composition inside the solid fuel burning device 28, ideal exhaust pressure, and ideal exhaust composition. In one aspect, the set of reference conditions can include an ideal fire usage curve. The ideal fire usage curve can be generated based on, but is not limited to, properties associated with the solid fuel burning device 28 and specified by the user, technical specifications, environmental factors, laboratory tests, and/or public policy information. The filtered information can be fit to the set of reference conditions by, for example, curve fitting, parametric or non-parametric equation fitting, linear or non-linear regression models, or the like. Based at least in part on fitting the filtered information to the set of reference conditions, at least one property related to usage of the solid fuel burning device 28 is determined. Properties related to usage of the solid fuel burning device 28 can include, but are not limited to, cold start, steady-state, overfire, long/slow burns, burn out, ignition, warm reload, catalyst engagement, open door, closed door, amount of fuel in firebox, or quality/dryness or wood.

The at least one of the properties related to the usage of the solid fuel burning device 28 can be compared to a lookup table to retrieve guidance for operation of the solid fuel burning device 28. The lookup table can be stored locally and/or remotely (e.g., cloud storage accessible by a plurality of users of a plurality of devices) and can include a plurality of triggering events correlated to properties related to usage of solid fuel burning devices. Examples of triggering events include, but are not limited to: the door is improperly open, the solid fuel needs more oxygen to combust, the catalyst has been triggered, the fuel is too low, the smoke contains too many particulates, the temperature is too low or too high, etc. If at least one of the properties related to the usage of the solid fuel burning device are determined to satisfy one of the plurality of triggering events, then the system retrieves guidance for rectifying the triggering event. The guidance can include, but is not limited to instructions such as: open the door, close the door, open the vent, add fuel, add drier fuel, or engage the bypass/baffle/vent/catalyst. For example, instructions can include "close your bypass in five minutes", "reload fuel in an hour", or "your fuel seems to be wet, consider testing with a moisture meter and/or obtaining drier fuel."

Figure 4:
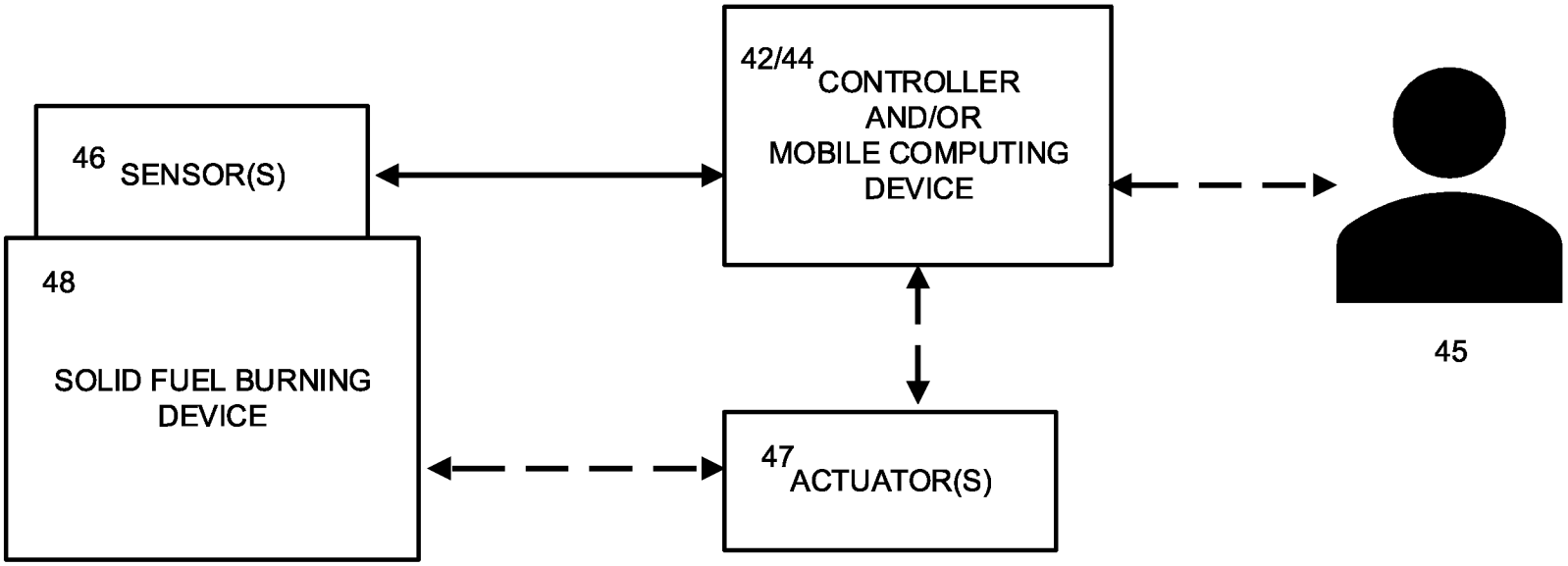
FIG. 4 is a schematic diagram showing how the system of FIG. 2 can communicate with a user and/or an actuator.

The guidance can be to a user and/or to an actuator. Optionally, the guidance can be output to the user through one or more displays. FIG. 4 shows how guidance can be output to a user 45 and/or an actuator 47 if the system includes a controller 42 and/or a mobile computing device 44 as shown in FIG. 2. The guidance can be output to only a user 45, only to at least one actuator 47 associated with the solid fuel burning device 48, or to both the user 45 and the at least one actuator 47. Optionally, the guidance can also be output with an alert to the user 45, such as a visual, tactile, and/or auditory alert to gain the user's attention. The system enables the user 45 to interact with the solid fuel burning device 48 based on the instructions of the outputted guidance. In one embodiment, the user 45 acts on the solid fuel burning device 48 based on the instructions and changes the operating conditions so that no triggering events are matched when the at least one sensor 46 is later sampled. In another embodiment, the at least one actuator 47 is configured to receive the guidance output by at least one processor (which can be embodied in the controller 42 and/or mobile device 44) and to perform an action on a component of the solid fuel burning device 48 based on the guidance. For example, the actuator 47 can move the door, the vent, the bypass, etc. of the solid fuel burning device 48. Optionally, the actuator 47 can also agitate the solid fuel and/or start/stop a fan associated with the solid fuel burning device 48.

In another aspect, if the user 45 interacts with the solid fuel burning device 48 based on the instructions of the outputted guidance, then the controller 42 and/or mobile computing device 44 can present the user 45 with a reward if the user 45 successfully performs the instructions. The reward can be visualized on a display associated with the controller 42 and/or the mobile computing device 44. For example, the reward can be a visual badge or an auditory sound congratulating the user 45 for following the guidance when the triggering event no longer exists. Optionally, the system can track how often the user 45 successfully uses the solid fuel burning device 48 (e.g., correctly responds to the triggering event). The system can reward the user 45 when the user 45 reaches a milestone, such as a certain number of times correctly responding to the guidance instructions or a certain number of grams of emission saved. The reward can be the visual badge or the auditory sound, each of which may also be accompanied by a monetary incentive (such as a discount on merchandise).

Figure 5:
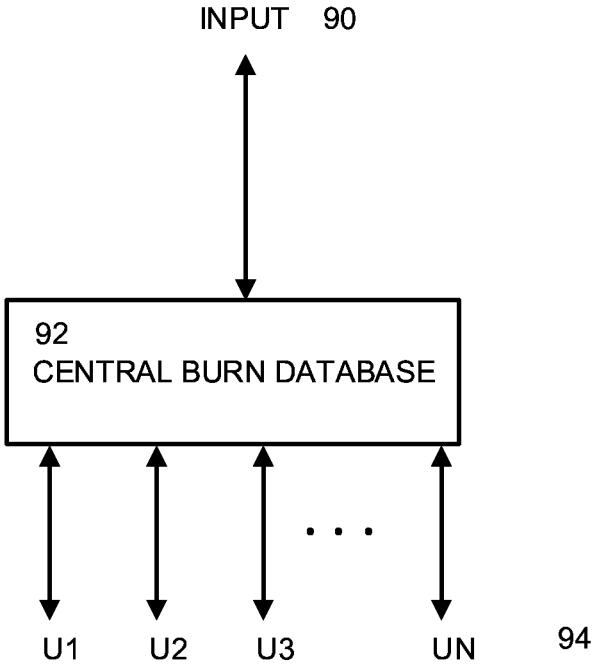
FIG. 5 is a schematic diagram showing example inputs and outputs of a central burn database.

Additionally, the system can send at least a portion of the information related to operating conditions sampled by the at least one sensor to a central burn database. As shown in FIG. 5, the information can be input 90 into the central burn database 92 and output to one or more of a plurality of users 94 (who can be associated with different permissions for different levels of access). The central burn database 92 can include performance data from a plurality of users and/or related to one or more solid fuel devices of a certain type or types and/or performance data from a plurality of solid fuel burning devices. The performance data can include information relating to the operating conditions of the solid fuel burning device and information relating to how the operating conditions of the solid fuel burning device change based on the user and/or the actuators actions on the solid fuel burning device.

The central burn database 92 can include different levels of access based on permissions associated with log-in credentials of different types of users in the plurality of users 94. The different users can include, for example, a user of a solid fuel burning device, a manufacturer of the solid fuel burning device, a laboratory researcher, and government officials/policy makers. Optionally, the user of the solid fuel burning device may only be able to access his or her own performance data and/or comparison charts of his or her own data with other users with the same type of solid fuel burning device, while the manufacturer, a laboratory researcher or government official may have access to a plurality of users' performance data and any underlying information collected from the at least one sensor associated with each solid fuel burning device.

Optionally, manufacturers, laboratory researches and government officials/policy makers can input new rules to the central burn database which can then be received by the at least one memory to alter the stored instructions. The alterations can include policy changes or updates to reference conditions and/or triggering events based on improved understanding of domestic use of solid fuel burning devices.

IV. Methods

Another aspect of the present disclosure can include methods 100, 120, 130, 140, and 150 as shown in FIGS. 6-10 for reducing emissions and improving the efficiency of a solid fuel burning device. The methods 100, 120, 130, 140, and 150 can be instructions stored on a non-transitory memory and executed by a hardware processor. For example, one or more elements of FIGS. 1-5 (e.g., a controller and/or a mobile device executing the system 10) can be used to implement the steps of methods 100, 120, 130, 140, and 150.

The methods 100, 120, 130, 140, and 150 are illustrated as a process flow diagram with flow chart illustrations. For purposes of simplicity, the methods are shown and described as being executed serially; however, it is to be understood and appreciated that the present disclosure is not limited by the illustrated order, as some steps could occur in different orders and/or concurrently with other steps shown and described herein. Moreover, not all illustrated aspects may be required to implement the methods.

Figure 6:
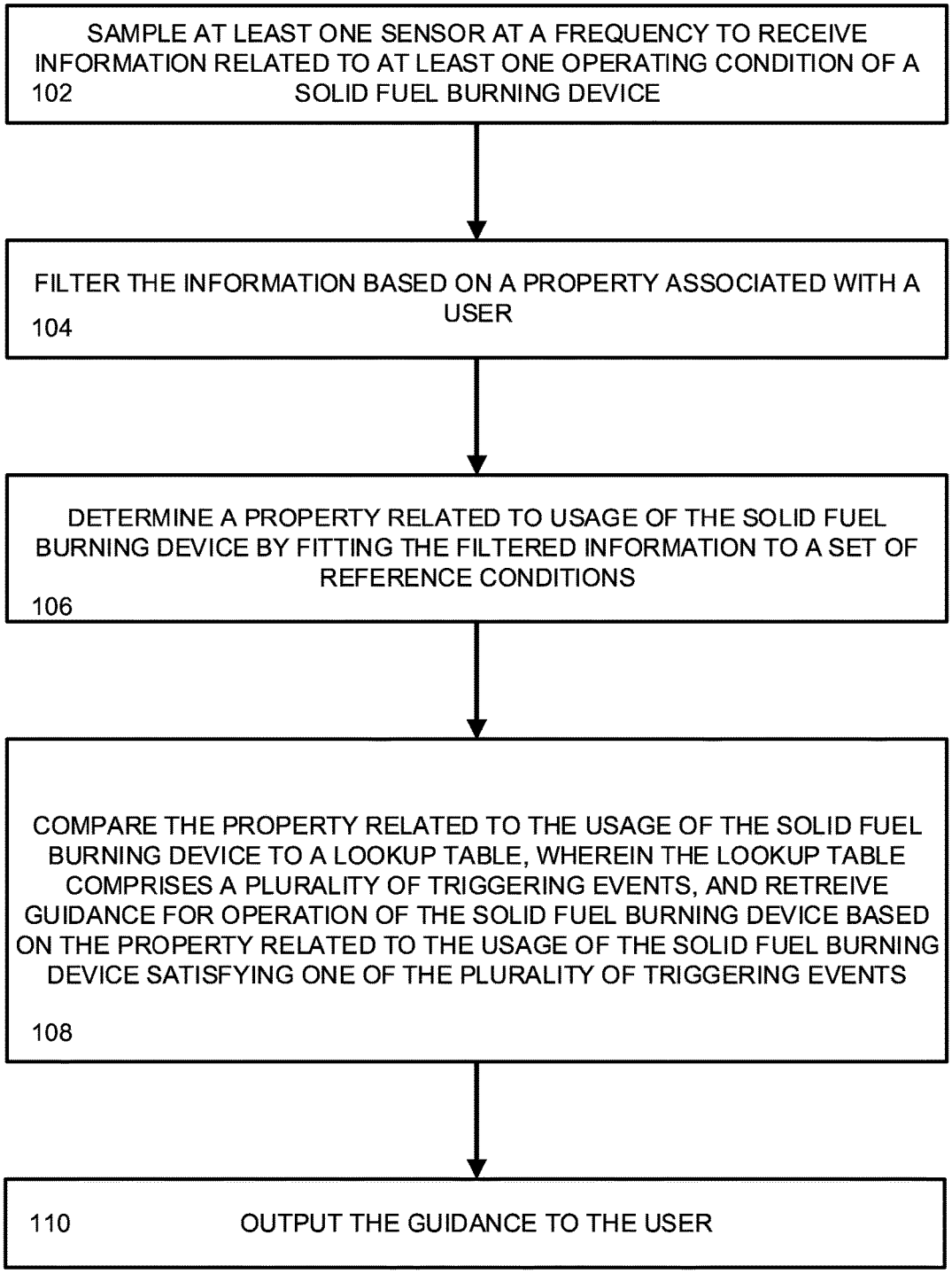
FIG. 6 is a process flow diagram showing a method for improving the efficiency and/or reduce emissions from a solid fuel burning device.

Referring now to FIG. 6, illustrated is a method 100 for facilitating the reduction of emissions and the efficiency improvement of a solid fuel burning device. At 102, at least one sensor can be sampled at a frequency to receive information related to at least one operating condition of a solid fuel burning device. The at least one sensor can be, for example, a mechanical sensor, temperature sensor, or chemical sensor. The type of sensor depends on where the at least one sensor is located and what operating condition the at least one sensor detects. The at least one sensor can be located inside the solid fuel burning device (e.g., in the firebox, in the exhaust pipe, on the door, etc.) or outside the solid fuel burning device (e.g., on the outside surface of the solid fuel burning device, in a room surrounding the solid fuel burning device, etc.). Operating conditions can include, but are not limited to, internal and external temperatures, the rate the temperatures change, if the door of the solid fuel device is open, the smoke and combustion levels generated by burning the solid fuel, etc. Optionally, information related to operating conditions can be stored in at least one non-transitory memory.

At 104, the information related to at least one operating condition of the solid fuel burning device can be filtered based on a property associated with the solid fuel burning device and specified by a user. The property associated with the solid fuel burning device and specified by the user can include, but is not limited to, at least one of: the type of solid fuel burning device the system is being used with, the specifications of the solid fuel burning device, the location of the at least one sensor, the user's desired type of burn (e.g., long/slow burn, quick burn, primary heating, secondary heating, etc.), or the user's goal emissions level. The property associated with the solid fuel burning device and specified by the user can be entered into the system directly or the system can determine the property associated with the solid fuel burning device and specified by the user by prompting the user to enter information (e.g., if prompted by the system) that the system can use to formulate the property associated with the user. Optionally, the property associated with the solid fuel burning device and specified by the user can be more than one property.

At 106, a property related to usage of the solid fuel burning device can be determined by fitting the filtered information to a set of reference conditions. The set of reference conditions can be based at least partially on at least one property associated with the solid fuel burning device and specified by the user, such as the specifications for the solid fuel burning device. The reference conditions can include, but are not limited to, the ideal internal/external temperatures for the solid fuel burning device, ideal air composition inside the solid fuel burning device (e.g., amount of $O_2$, etc.), ideal exhaust pressure, and ideal exhaust composition (e.g., amount of carbon monoxide, carbon dioxide, particulate matter, etc.). In one aspect, the set of reference conditions can include an ideal fire usage curve. At least one property related to usage of the solid fuel burning device is determined by fitting the filtered information to the set of reference conditions. Properties related to usage of the solid fuel burning device can include, but are not limited to, cold start, steady-state, overfire, long/slow burns, burn out, ignition, warm reload, catalyst engagement, open door, closed door, amount of fuel in firebox, or quality/dryness or wood.

At 108, the property related to the usage of the solid fuel burning device can be compared to a lookup table, wherein the lookup table includes a plurality of triggering events, and guidance for operation of the solid fuel burning device can be retrieved based on the property related to usage of the solid fuel burning device satisfying one of the plurality of triggering events. Examples of triggering events include, but are not limited to: the door is improperly open, the solid fuel needs more oxygen to combust, the catalyst has been triggered, the fuel is too low, the smoke contains too many particulates, the temperature is too low or too high, etc. Examples of guidance retrieved based on the property related to usage of the solid fuel burning device can include, but are not limited to instructions such as: open the door, close the door, open the vent, add fuel, add drier fuel, or engage the bypass/baffle/vent/catalyst. For example, instructions can include "close your bypass in five minutes", "reload fuel in an hour", or "your fuel seems to be wet, consider testing with a moisture meter and/or obtaining drier fuel."

At 110, the guidance can be output. The guidance is designed to reduce emissions and/or increase efficiency of the solid fuel burning device. The guidance can be output to a user and/or to an actuator. For example, the guidance can be output by at least one display associated with the controller and/or mobile computing device of system 10. The at least one display can include a visual display, at least one speaker, and/or a haptic motor.

Figure 7:
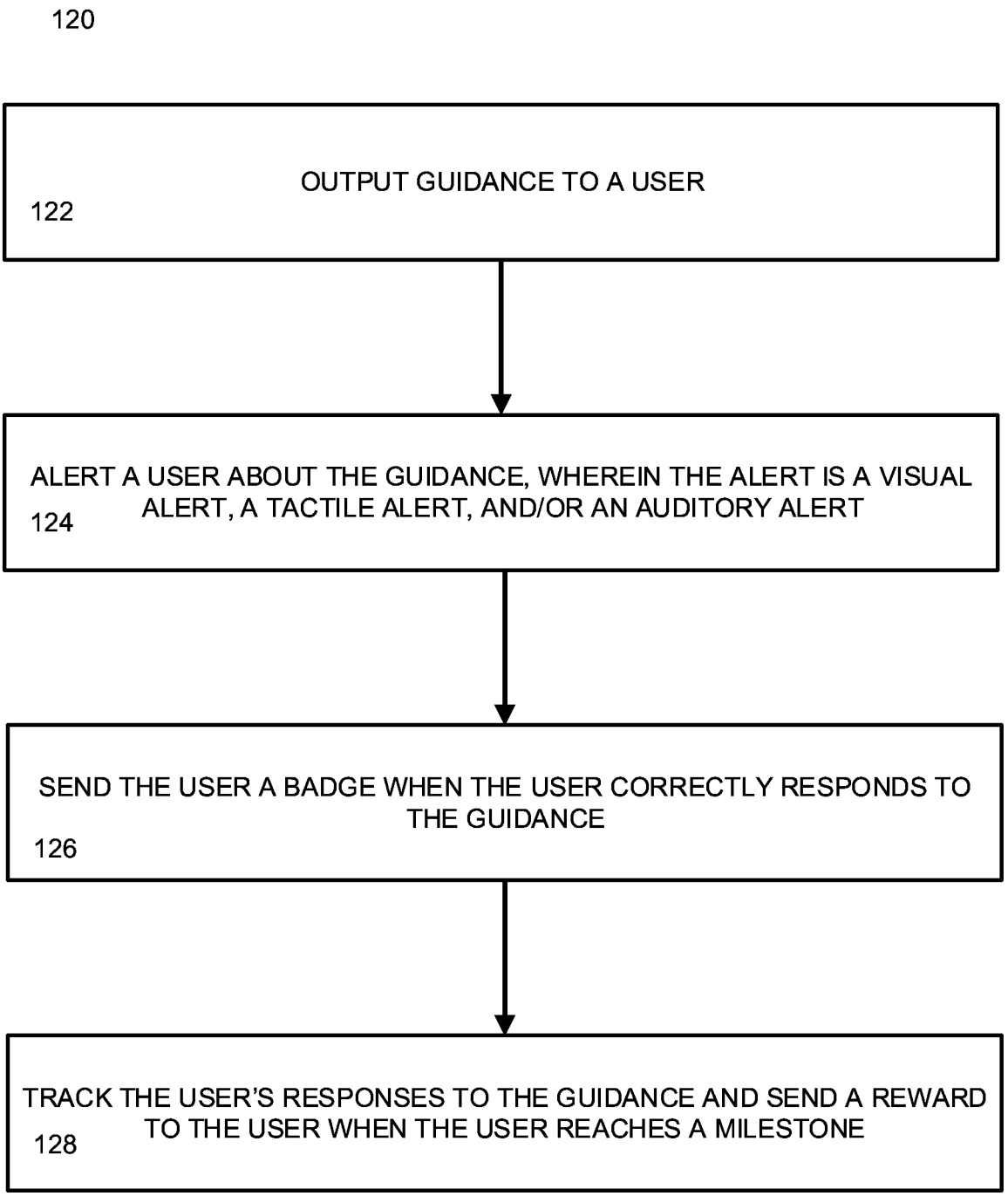
FIG. 7 is a process flow diagram showing a method for outputting guidance to a user of a solid fuel burning.

Referring now to FIG. 7, illustrated is a method 120 for improving a user's effective use of a solid fuel burning device. At 122, the guidance can be output to a user. For example, the guidance can be output through at least one display (e.g., written, visual, or animated instructions on the visual display or verbal instructions through the at least one speaker). At 124, a user can be alerted about the guidance, wherein the alert is a visual alert, a tactile alert, and/or an auditory alert. For example, the alert about the guidance can be generated by the at least one display, e.g., the visual alert can include words, pictures, or animations on the visual display, the tactile alert can be a vibration generated by the haptic motor, and the auditory alert can be sounds (e.g., alarms, music, words, etc.) generated by the at least one speaker.

In one aspect, after the user interacts with the solid fuel burning device based on the outputted guidance the system can determine if the user has successfully removed the triggering event. At 126, the user can be sent a badge (e.g., an emotional reward such as a visual congratulations on at least one display) when the user correctly responded to the guidance. In another aspect, at 126, the user's responses to the guidance can be tracked and a reward can be sent to the user when the user reaches a milestone. Non-limiting examples of milestones include: one hundred times correctly responding to guidance, ten thousand grams of emissions saved, etc. Rewards can include, for example, emotional rewards (e.g., a visual badge, an auditory sound) and/or a monetary incentive (e.g., a discount on merchandise related to solid fuel burning).

Figure 8:
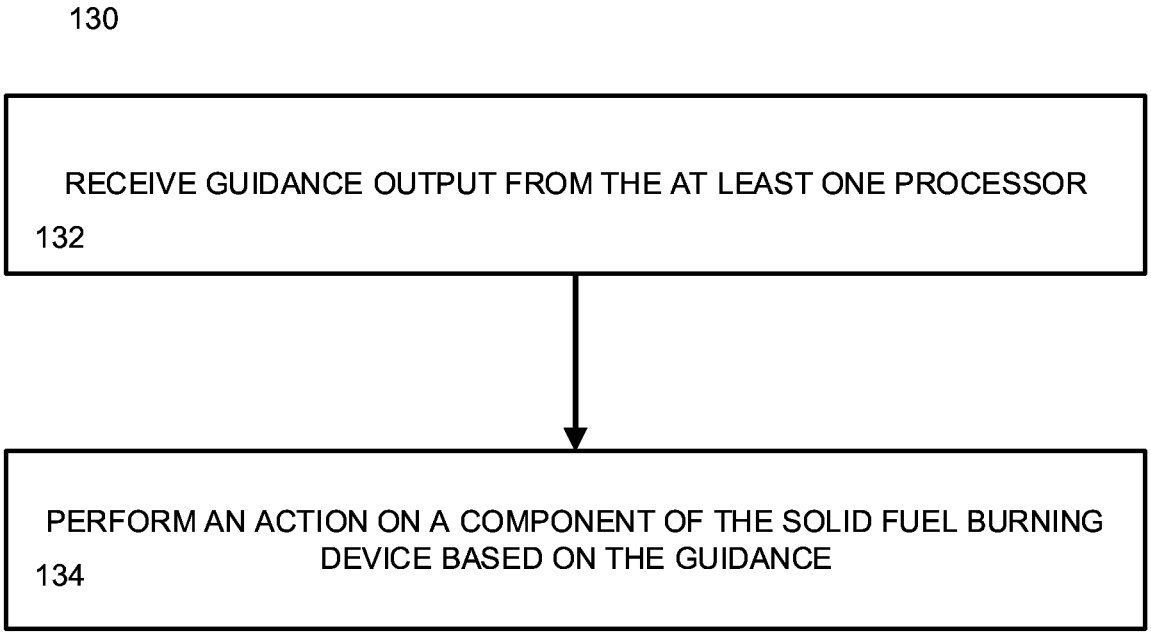
FIG. 8 is a process flow diagram showing a method for using an actuator with a solid fuel burning device.

Referring now to FIG. 8, illustrated is a method 130 for improving the effective use of a solid fuel burning device with at least one actuator associated with the solid fuel burning device. At 132, guidance output from the controller and/or mobile device can be received (e.g., by at least one actuator). The guidance can also be simultaneously output to a user of the solid fuel burning device. Optionally, the guidance can include a notification (visual or audio) that the actuator also received the guidance (e.g., so the user knows not to respond to the guidance). At 134, the at least one actuator can perform an action on a component of the solid fuel burning device based on the guidance. For example, the actuator can open/close the door, open/close the vent, open/close the bypass, or interact with the catalyst. The action of the actuator is configured to remove the triggering event, if the action does not, then the user can be notified to follow the appropriate guidance to rectify the triggering event.

Figure 9:
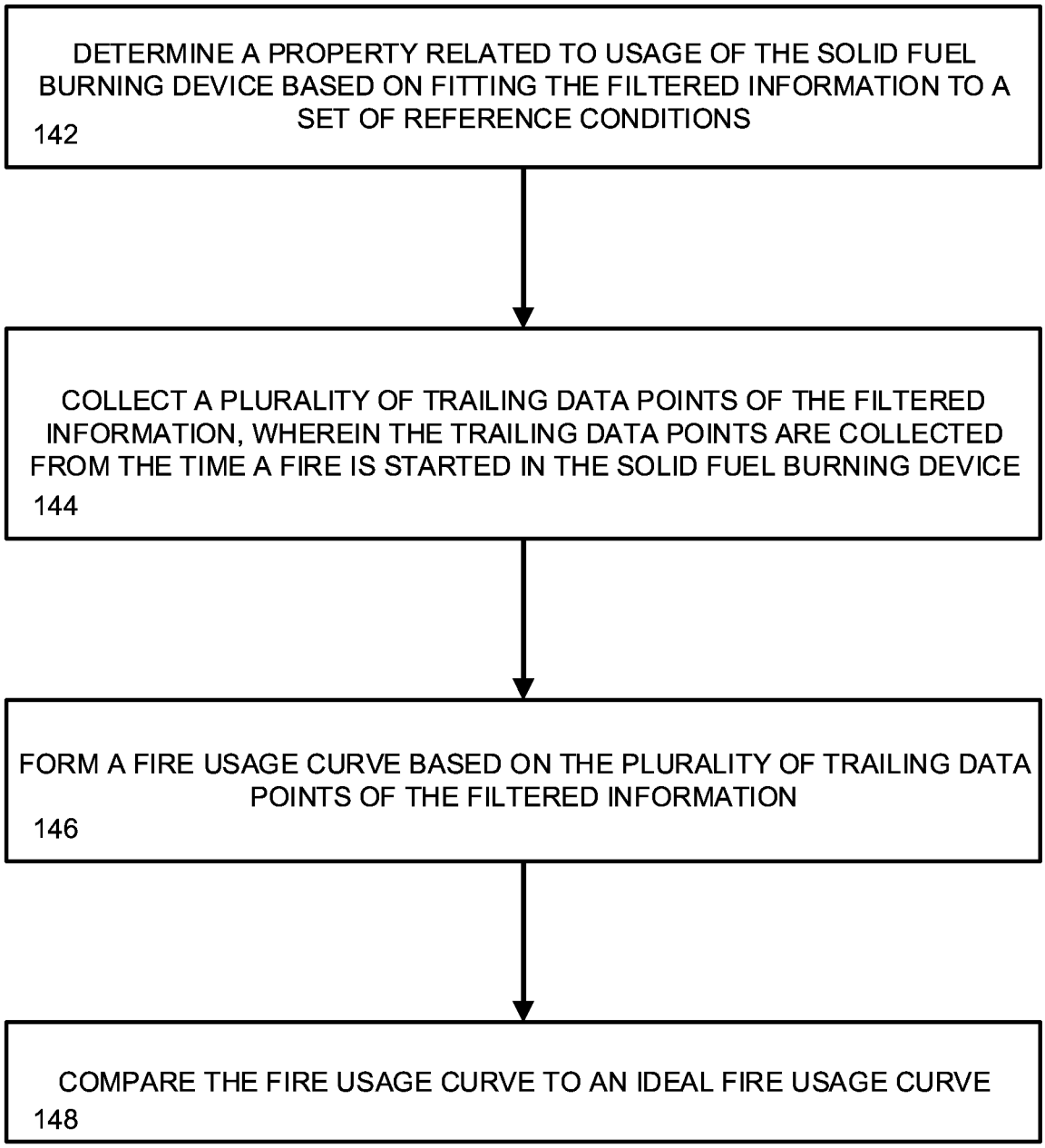
FIG. 9 is a process flow diagram showing an example method for fitting filtered information to a set of reference conditions.

Referring now to FIG. 9, illustrated is a method 140 for an example of fitting filtered information to a set of reference conditions, wherein the set of reference conditions are an ideal fire usage curve. At 142, a property related to usage of the solid fuel burning device can be determined based on fitting the filtered information to a set of reference conditions. At 144, a plurality of trailing data points of the filtered information can be collected. The trailing data points are collected from the time a fire (e.g., any form of combustion) is started in the solid fuel burning device. The trailing data points can include, for example, every sensor sample or the trailing data points can be a subset of the sensor samples (e.g., the number of trailing data points can directly correspond to the frequency of sensor sampling or the number of trailing data points can be proportionally less than the number of sensor samples over the given time period). At 146, a fire usage curve can be formed based on the plurality of trailing data points for the current fire (e.g., since the current combustion began) The fire usage curve can differentiate between collected data points and extrapolated data points, wherein the extrapolated data points can represent where future data points would likely go if no changes are made to the use of the solid fuel burning device. At 148, the fire usage curve (for the current fire) can be compared to an ideal fire usage curve. The ideal fire usage curve can be determined based on properties associated with the user, technical specifications, environmental factors, laboratory tests, and/or public policy information. At least one property related to usage of the solid fuel burning device can be determined based on the comparison between the fire usage curve for the current fire and the ideal fire usage curve (e.g., based on the similarities and differences between the two curves at least one property related to usage of the solid fuel burning device that should be addressed for an efficient burn can be determined).

Figure 10:
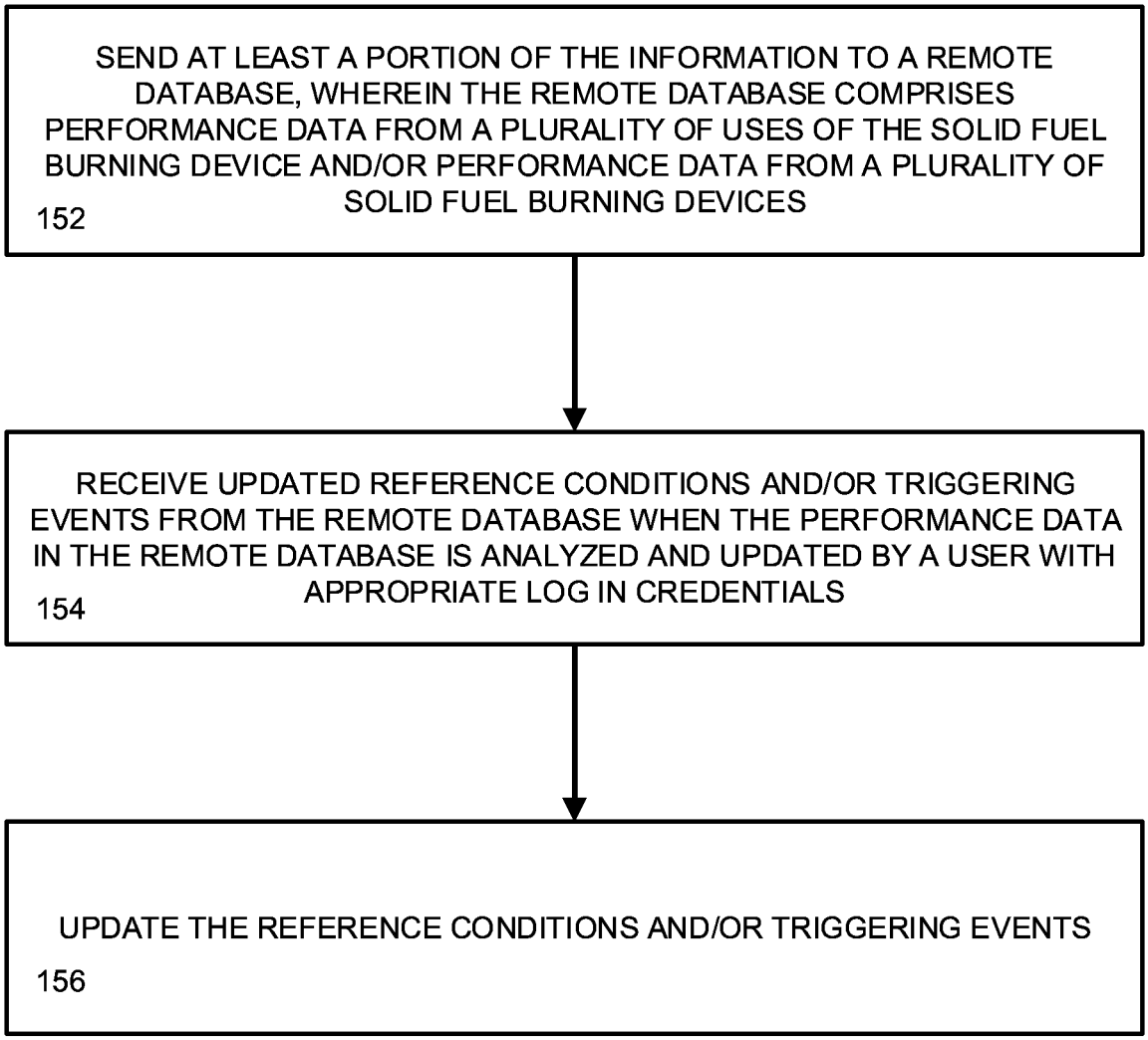
FIG. 10 is a process flow diagram showing methods for creating and utilizing a central burn database.

Referring now to FIG. 10, illustrated is a method 150 for creating and utilizing a remote central burn database for the improvement of solid fuel burning device efficiency and the reduction of solid fuel burning device emissions. At 152, at least a portion of the information (e.g., the information sampled by the at least one sensor 26) can be sent to a remote database. The at least a portion of the information can include performance data from a plurality of uses of the solid fuel burning device and/or performance data from a plurality of solid fuel burning devices. Performance data can include, for example, information relating to the operating conditions of the solid fuel burning device and information relating to how the operating conditions of the solid fuel burning device change based on the user and/or the actuators actions on the solid fuel burning device. The remote database can include different levels of access based on permissions associated with log-in credentials of different types of users. The different types of users can include, for example, a user of a solid fuel burning device, a manufacturer of the solid fuel burning device, a laboratory researcher, and government officials/policy makers. The user of the solid fuel burning device may only be able to access his or her own performance data or comparison charts of his or her own data with other users with the same type of solid fuel burning device. A manufacturer of the solid fuel burning device, a laboratory researcher, or government official can have access to a plurality of users' performance data and any underlying information collected from the at least one sensor associated with each solid fuel burning device and sent to the remote database. Manufacturers of the solid fuel burning device, laboratory researchers, and/or government officials/policy makers can input new rules to the remote database. The new rules can include policy changes or updates to reference conditions and/or triggering events based on improved understanding of domestic use of solid fuel burning devices.

At 154, updated reference conditions and/or triggering events can be received from the remote database when the performance data in the remote database is analyzed and updated by a user with appropriate log-in credentials, as described above. At 156, the reference conditions and/or triggering events can be updated) when the updates are received. The updated reference conditions and/or triggering events can further assist a user in more efficient use of the user's solid fuel burning device and in reducing emissions from the solid fuel burning device.

From the above description, those skilled in the art will perceive improvements, changes and modifications. Such improvements, changes and modifications are within the skill of one in the art and are intended to be covered by the appended claims. All patents, patent applications, and publications cited herein are incorporated by reference in their entirety.

The following is claimed:

1. A system comprising:

at least one memory storing instructions; and at least one processor configured to execute the instructions to at least:

sample at least one sensor at a frequency to receive information related to at least one operating condition of a solid fuel burning device;

filter the information based on a property associated with the solid fuel burning device and specified by a user to remove information not needed to properly operate the solid fuel burning device and store remaining filtered information in the memory;

determine a property related to usage of the solid fuel burning device by comparing the filtered information to an ideal fire usage curve, wherein the filtered information comprises a plurality of trailing data points from a time a fire is started in the solid fuel burning device, and wherein a current fire usage curve is formed based on the plurality of trailing data points and the at least one property related to usage is determined by comparing a fit of the current fire usage curve with the ideal fire usage curve;

compare the property related to the usage of the solid fuel burning device to a lookup table, wherein the lookup table comprises a plurality of triggering events and is updated based on a central burn database comprising performance data from a plurality of uses of the solid fuel burning device and performance data from a plurality of uses of a plurality of other solid fuel burning devices, and retrieve guidance for operation of the solid fuel burning device based on the property satisfying one of the plurality of triggering events; and output the guidance to an actuator associated with the solid fuel burning device to perform an action on a component of the solid fuel burning device, wherein the guidance improves the fit of the current fire usage curve with the ideal fire usage curve and/or reduce emissions and/or increase efficiency of the solid fuel burning device.

2. The system of claim 1, further comprising a controller comprising the at least one memory and the at least one processor configured to at least sample the at least one sensor at the frequency.

3. The system of claim 2, further comprising a mobile computing device comprising another of the at least one memory and another of the at least one processor configured to at least output the guidance.

4. The system of claim 3, further comprising the at least one sensor, wherein the at least one sensor is located outside the solid fuel burning device.

5. The system of claim 4, wherein the at least one sensor is located on at least one of on top of the solid fuel burning device, on an exhaust pipe of the solid fuel burning device, on a thermostat located in a building housing the solid fuel burning device, and on a door of the solid fuel burning device.

6. The system of claim 4, further comprising at least one other sensor located inside the solid fuel burning device in at least one of: a primary firebox, a secondary combustion area, a catalytic combustor, and an exhaust pipe.

7. The system of claim 4, wherein the at least one sensor comprises a temperature sensor and/or a mechanical sensor.

8. The system of claim 3, wherein the mobile device and/or the controller enables user interaction with the solid fuel burning device based on the guidance.

9. The system of claim 1, wherein the guidance is output with an alert to the user, wherein the alert is a visual alert, a tactile alert, and/or an auditory alert.

10. The system of claim 1, wherein the at least one processor sends at least a portion of the filtered information to the central burn database comprising performance data from the plurality of uses of the solid fuel burning device and/or performance data from the plurality of solid fuel burning devices.

11. The system of claim 10, wherein the central burn database comprises different levels of access based on permissions associated with log-in credentials of different users.

12. The system of claim 1 further comprising the solid fuel burning device and at least one actuator associated with the solid fuel burning device.

13. The system of claim 12, wherein the at least one actuator is configured to receive the guidance and to perform an action on a component of the solid fuel burning device based on the guidance.

14. The system of claim 1, wherein the guidance further comprises parameters that optimize heat output, user experience, and/or safety.

15. A method comprising:

sampling, by a system comprising at least one processor, at least one sensor at a frequency to receive information related to at least one operating condition of a solid fuel burning device;

filtering, by the system, the information based on a property associated with the solid fuel burning device and specified by a user to remove information not needed to properly operate the solid fuel burning device, wherein remaining information is stored as filtered information;

determining, by the system, a property related to usage of the solid fuel burning device by comparing the filtered information to an ideal fire usage curve, wherein the filtered information comprises a plurality of trailing data points from a time a fire is started in the solid fuel burning device, and wherein a current fire usage curve is formed based on the plurality of trailing data points and the at least one property related to usage is determined by comparing a fit of the current fire usage curve with the ideal fire usage curve;

comparing, by the system, the property related to the usage of the solid fuel burning device to a lookup table, wherein the lookup table comprises a plurality of triggering events and is updated based on a central burn database comprising performance data from a plurality of uses of the solid fuel burning device and performance data from a plurality of uses of a plurality of other solid fuel burning devices, and retrieving guidance for operation of the solid fuel burning device based on the property satisfying one of the plurality of triggering events;

outputting, by the system, the guidance to the user, wherein the guidance improves the fit of the current fire usage curve with the ideal fire usage curve and/or reduce emissions and/or increase efficiency of the solid fuel burning device; and sending the guidance to at least one actuator associated with the solid fuel burning device, wherein the at least one actuator receives the guidance and performs an action on a component of the solid fuel burning device based on the guidance.

16. The method of claim 15 further comprising sending, by the system, at least a portion of the filtered information to a remote database, wherein the remote database comprises performance data from the plurality of uses of the solid fuel burning device and/or performance data from the plurality of uses of the plurality of other solid fuel burning devices.

17. The method of claim 16, wherein the remote database has different levels of access based on permissions affiliated with log-in credentials.

18. The method of claim 15, wherein the guidance further comprises optimizing heat output, user experience, and/or safety.

* * * * *